US005836320A

United States Patent [19]

Gueret

[11] Patent Number: 5,836,320

[45] Date of Patent: Nov. 17, 1998

[54] DEVICE FOR PACKAGING AND APPLYING A COSMETIC

[75] Inventor: Jean-Louis Gueret, Paris, France

[73] Assignee: L'Oreal, Paris, France

[21] Appl. No.: 644,296

[22] Filed: May 13, 1996

[30] Foreign Application Priority Data

May 16, 1995 [FR] France ..... 95 05771

[51] Int. Cl.[6] ..... A45D 40/26

[52] U.S. Cl. ..... 132/317; 401/208; 401/218

[58] Field of Search ..... 401/208, 209, 401/218; 132/320, 293, 317, 298, 299; 220/756, 318; 215/397

[56] References Cited

U.S. PATENT DOCUMENTS

| | | | |
|---|---|---|---|
| 1,747,318 | 2/1930 | Pennock | 132/298 |
| 2,193,509 | 3/1940 | Deakers et al. . | |
| 2,267,179 | 12/1941 | Wells . | |
| 2,311,367 | 2/1943 | Chambers . | |
| 2,654,108 | 10/1953 | Scelsi | 401/209 |
| 2,783,489 | 3/1957 | Bogoslowsky et al. . | |
| 3,075,230 | 1/1963 | Marchant . | |
| 3,441,353 | 4/1969 | Claff | 401/208 |
| 4,555,195 | 11/1985 | DeVreeze et al. | 401/208 |
| 4,627,758 | 12/1986 | Winthrop | 401/218 |
| 4,817,526 | 4/1989 | Winston | 401/218 |
| 5,391,011 | 2/1995 | Gueret | 132/320 |

FOREIGN PATENT DOCUMENTS

| | | | |
|---|---|---|---|
| 0 611 184 A1 | 8/1994 | European Pat. Off. . | |
| 0 686 407 | 7/1930 | France . | |
| 0 843 007 | 6/1939 | France . | |
| 1 069 233 | 7/1954 | France . | |
| 2006459 | 4/1978 | Germany | 401/218 |
| 164764 | 9/1980 | Netherlands | 401/218 |
| 1175860 | 1/1970 | United Kingdom | 401/218 |

*Primary Examiner*—Todd E. Manahan
*Assistant Examiner*—Eduando C. Robert
*Attorney, Agent, or Firm*—Oliff & Berridge, PLC

[57] ABSTRACT

A device for packaging and applying a cosmetic includes a housing suitable for containing cosmetic, an applicator element for applying the cosmetic, and a transfer device for feeding the applicator element with cosmetic taken from inside the housing. The transfer device includes a coating roller capable of rotating inside the housing. The roller has a region of its surface that is capable of coming into contact with the applicator element and exerting contact pressure thereon. Another region of its surface is capable of coming into contact with the cosmetic contained in the housing. Rotation of the roller conveys a coating of cosmetic between the regions for transfer to the applicator element. The coating roller is secured to a drive mechanism that is accessible to a user outside the housing.

15 Claims, 2 Drawing Sheets

DEVICE FOR PACKAGING AND APPLYING A COSMETIC

The present invention relates to devices for packaging and applying a cosmetic such as makeup in powder form.

BACKGROUND OF THE INVENTION

The invention relates more particularly to a device of the type comprising a box suitable for containing a cosmetic, an applicator element for applying the cosmetic, and transfer means for feeding the applicator element with the cosmetic.

Such a device is described, for example, in European patent application EP-A-0 611 184 and French patent No. 843 007.

OBJECTS AND SUMMARY OF THE INVENTION

A particular object of the invention is to further improve control over the quantity of cosmetic dispensed by the applicator element, and the quality of the transfer of cosmetics onto the skin of the user.

This object is achieved by providing a device for packaging and applying a cosmetic, the device comprising a housing suitable for containing said cosmetic, an applicator element for applying said cosmetic, and transfer means for feeding the applicator element with cosmetic taken from inside the housing, said transfer means including a coating roller capable of rotating inside the housing, said roller having a region of its surface that is capable of coming into contact with the applicator element and of exerting contact pressure thereon, and a region of its surface that is capable of coming into contact with the cosmetic contained in the housing, rotation of the roller conveying a coating of cosmetic between said regions for transfer to the applicator element because of said contact pressure, wherein the coating roller is secured to drive means accessible to the user outside the housing.

Thus, by making it possible to select the extent of the contacting surfaces of the coating roller and of the applicator element, and also the contact pressure, it is possible to act accurately on the impregnation conditions of the applicator element so as to adapt them as well as possible to the nature of the cosmetic and to the quantity to be dispensed.

In a preferred embodiment of the invention, the applicator element is a rotary member.

Advantageously, the coating roller and the said rotary member are organized to rotate in contact one with the other and have a transmission ratio selected so that said rotary member performs at least one complete turn when the coating roller performs half a turn, or in a variant one-fourth of a turn.

In an embodiment of the invention, the device includes means suitable for preventing rotation of the rotary member while the cosmetic is being applied to the skin.

In an embodiment of the invention, the device includes removable fixing means for fixing the applicator element on the housing. Advantageously, said removable fixing means include a pivoting clasp rotatable with the coating roller and suitable for being moved onto the applicator element to hold it on the housing.

In an embodiment of the invention, the coating roller is urged by resilient return means against the applicator element. In a variant, or additionally, the applicator element is urged by resilient return means against the coating roller.

Advantageously, the coating roller is of a shape that fits closely to the shape of the applicator element.

In an embodiment of the invention, said cosmetic is contained in a removable container.

In an embodiment of the invention, the applicator element is fixed in non-rotatable manner to a handle member that is removable, and the applicator element is made of a cellular material or of an elastomer cellular material.

BRIEF DESCRIPTION OF THE DRAWINGS

Other characteristics and advantages of the present invention appear on reading the following detailed description and examining the accompanying drawings, in which.

MORE DETAILED DESCRIPTION

Figure 1:
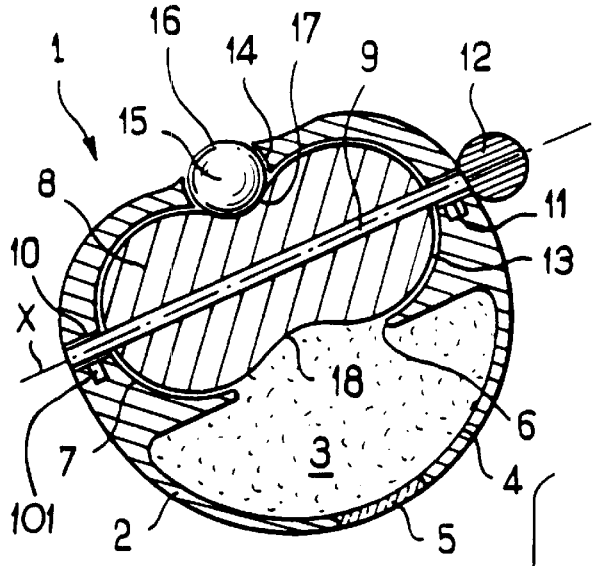
FIG. 1 is a diagrammatic section view of a first embodiment of a device of the invention.

FIG. 1 shows a packaging and applicator device 1 constituting a first embodiment of the invention.

The device 1 comprises a housing 2 containing a cosmetic 3. The cosmetic is contained in a cavity 4 formed in the bottom portion of the housing 2. A window 5 of transparent plastics material enables the inside of the cavity 4 to be seen and allows the user to see how full the device is and/or what color of cosmetic it contains. The window 5 advantageously closes an opening that also serves for filling the cavity 4. The top of the cavity 4 opens out via an opening 6 into a cavity 7 within which a coating roller 8 is free to rotate about an axis of rotation X. The coating roller 8 is secured to a shaft 9 having one axial end received in a recess 10 formed in the housing 2. The shaft 9 has its other axial end passing through the housing 2 via a hole 11 and is provided outside the housing 2 with a drive knob 12.

The coating roller 8 occupies nearly all of the cavity 7, with only a small amount of clearance 13 being provided to enable it to rotate the coating roller 8 may be urged by resilient return means 101 against the applicator element.

An opening 14 is made in the top portion of the housing 2 and has an applicator element passing therethrough, which element is constituted in the example described by a ball 15. The outside of the opening 14 is defined by a circular rim whose diameter is smaller than that of the ball 15, thereby retaining the ball in the housing 2.

The ball 15 has a region 16 of its surface situated outside the housing so as to be ready for applying to the skin when the device is in use, and it has a region 17 in contact with the coating roller 8. The regions 16 and 17 are diametrically opposite and the coating roller 8 keeps the ball 15 in place in the opening 14.

In its middle region, the coating roller 8 has an annular region of necking 18 that is circularly symmetrical about the axis X and that has a profile which, when observed in a section plane containing the axis X, constitutes an arc of a circle whose radius matches that of the ball 15. The necking 18 thus fits closely to the shape of the ball 15 for transferring, by contact, a coating of the cosmetic that covers the outside surface of the coating roller 8 onto the surface of the ball 15 situated in the region 17.

Before using the device 1 for applying a cosmetic, the user turns the knob 12 and brings the portion of the surface of the coating roller 8 that was initially situated in the opening 6 and that is therefore coated in cosmetic 3 into contact with the ball 15. The coating of cosmetic 3 transported by the coating roller 8 is transferred by contact pressure onto the ball 15. Friction between the coating roller 8 and the ball 15 also ensures that the ball is rotated by the coating roller 8 when the knob 12 is turned. This rotation of the ball 15 serves to renew the surface situated in the region 16 with a surface that was previously situated in contact with the coating roller 8 and that is coated in cosmetic 3.

Advantageously, the coating roller is made of a flexible material and the distance between the axis of the rotation of the ball and the axis of rotation of the coating roller is selected to be small enough for the surface of the coating roller to deform on making contact with the ball, thereby ensuring good contact between them and good transfer of cosmetic to the ball.

To use the device 1, the user moves the ball 15 in contact with the skin. Friction between the region 16 of the ball 15 and the skin causes the cosmetic to be transferred to the skin.

To enable cosmetic to be transferred effectively to the skin, the ball 15 does not revolve during application. For this purpose, care is taken, for example, to ensure that the coating roller 8 revolves with considerable friction inside the housing 2, and sufficient contact pressure is maintained between the ball 15 and the coating roller 8 to ensure that the roller prevents the ball 15 from rotating while it is in use.

The housing 2 may be constituted by uniting two half-shells which are assembled together after the ball 15 and the coating roller 8 on its shaft 9 have been installed in one of them.

Figure 2:
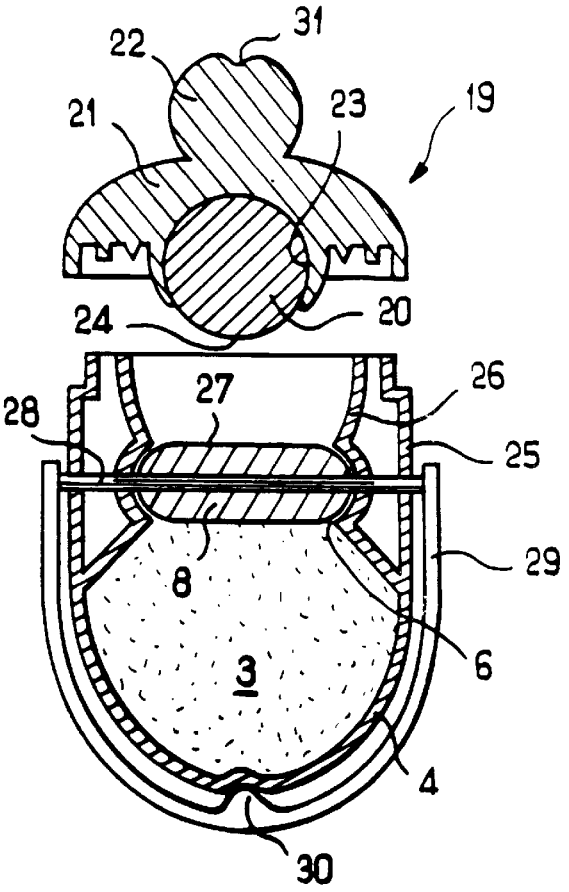
FIG. 2 is a diagrammatic section view of a second embodiment of a device of the invention.
Figure 3:
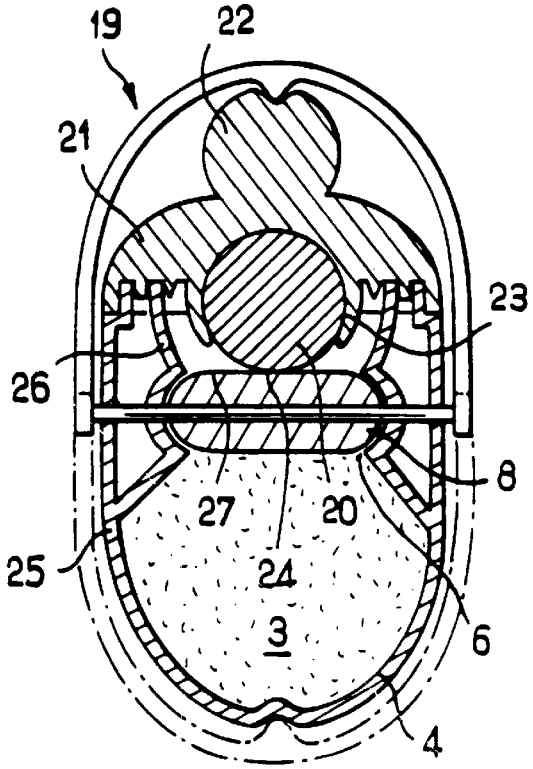
FIG. 3 show the FIG. 2 device in its storage position.

FIGS. 2 and 3 show a device 19 constituting a second embodiment of the invention.

In the description below, certain elements that are functionally analogous to those of the above embodiment are given identical reference symbols and are not described again in detail.

The device 19 differs essentially from the preceding device in that the applicator element can be disconnected from the housing while it is in use.

More precisely, the applicator element is constituted in this example by a ball 20 which is carried by a support 21 provided with a handle 22. The support 21 includes a spherical socket 23 in which the ball 20 is received and in which it can revolve.

The ball 20 has a region 24 situated outside the socket 23 and designed to come into contact with the skin while the device is in use.

The support 21 and the housing 25 containing the cosmetic, are shaped so as to be assembled together as shown in FIG. 3.

More precisely, the support 21 is applied to the top of the housing 25 and the ball 20 penetrates into a socket 26 formed in the top of the housing. The coating roller 8 opens out via a region 27 of its surface into the bottom of the socket 26. When the support 21 is in place on the housing 25, the region 24 of the ball 20 and the region 27 of the coating roller 8 come into contact.

The coating roller 8 is secured to a shaft 28 whose ends project outside the housing 25 and rotate with an arcuate clasp 29 capable of encompassing the support 21 so as to hold it in place on the housing 25. Advantageously, as shown, the middle of the arcuate clasp 29 includes a projection 30. The projection extends from the concave side of the arcuate clasp 29 and snaps into a recess 31 in the handle 22 in order to prevent the clasp 29 from rotating away from its position in which it holds the support 21 on the housing 25. When the clasp 29 is moved, it rotates the coating roller 8. Because of the contact between the regions 24 and 27, the ball 20 is rotated by the coating roller 8 and is coated in cosmetic 3 on making contact therewith.

Preferably, the transmission ratio between the coating roller 8 and the ball 20 is selected so that the ball 20 revolves at least once when the clasp 29 makes half a turn, so that moving the clasp 29 to release the support 21 causes the ball 20 to be coated completely.

Like the previously-described embodiment, the ball 20 does not rotate in its support 21 while the cosmetic is being applied to the skin. To prevent the ball rotating during application, means are provided to lock the ball against rotation in its support, e.g. sufficient friction between the ball 20 and the support 21. In a variant, the support may be provided with a pusher (not shown) enabling rotation of the ball 20 to be blocked.

Figure 4:
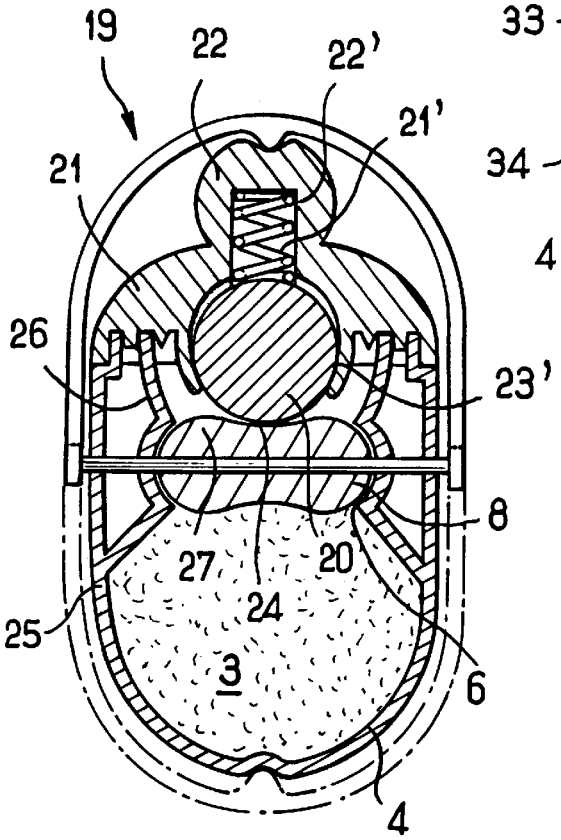
FIG. 4 shows a variant embodiment of the device shown in FIGS. 2 and 3.

FIG. 4 shows a variant embodiment in which the ball 20 is urged by a spring 21' against the coating roller 8. The spring 21' is received in a recess 22' of the handle 22. The ball 20 can be pushed back into its socket 23', compressing the spring 21'. The coating roller is advantageously suitable for deforming in contact with the ball 20 so as to match the shape thereof for effective transfer of cosmetic.

Figure 5:
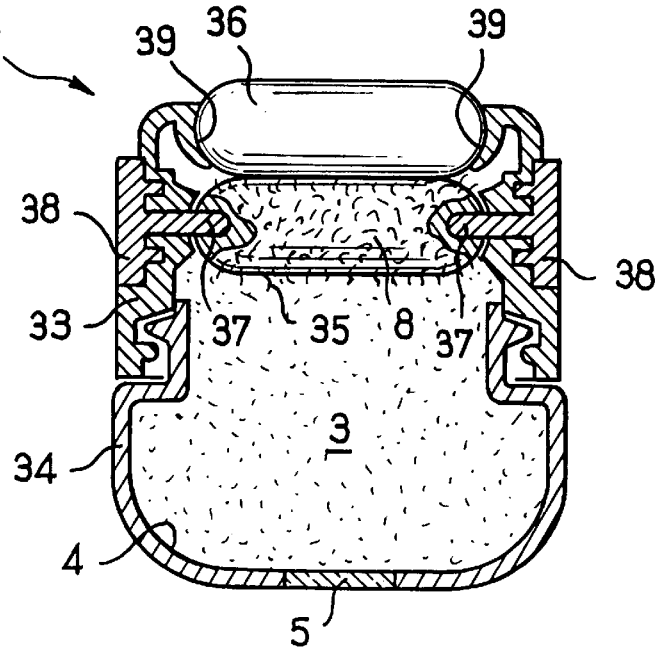
FIG. 5 is a diagrammatic section view of a third embodiment of a device of the invention.

FIG. 5 shows a device 32 in which the applicator element and the coating roller are carried by a removable support 33 which is snap-fastened on a cosmetic-containing container 34. In the example described the applicator element is constituted by a roller 36 and the coating roller 8 is covered in bristles 35. Its axial ends are secured to drive fingers 37 each of which rotates relative to the support 33 and is provided with a respective drive knob 38 situated on the outside of the support 33. The axial ends of the roller 36 are engaged in two concave sockets 39 that face each other and that are shaped to serve as bearings for rotatably mounting the roller 36 on the support 33.

In a variant, the coating roller may be secured at its ends to an arcuate clasp serving to hold a lid on the support 33, closing the device when it is not in use. Each time the device is used, the user rotates the clasp through one-fourth of a turn or more so as to remove the lid, thereby rotating the coating roller and coating the applicator roller 36 in cosmetic.

Finally, the invention makes it possible to feed the applicator element with makeup in controlled manner.

By selecting the extent of the surfaces in contact of the applicator element and of the coating roller, and by selecting the contact pressure, it is easy to adjust the quantity of cosmetic dispensed by the device as a function of the nature of the cosmetic.

When the applicator element and the coating roller are received in the same housing, then the housing is advantageously is shaped in such a manner that the coating roller isolates the applicator element from the cavity in the housing that contains the cosmetic, thereby improving sealing during storage and conservation of the cosmetic.

The presence of the coating roller closing the cavity that contains the cosmetic also makes it possible for the applicator element to be removable.

Depending on the contact pressure that is desired between the coating roller and the applicator element and on the nature of the cosmetic to be dispensed, the coating roller can be made of a plastics material that is either solid or cellular, having cells that are either open or closed, with the plastics material being, possibly, an elastomer, an elastomer foam, polyethylene, or polyurethane, in particular. The roller may also be made of a composite material, having regions of different hardnesses.

The shape of the coating roller is not limited to the examples described above. Without going beyond the ambit of the invention, the axial section of the roller may have a profile that is concave, convex, or other in shape. The surface of the coating roller may also be treated so as to make it greasy so that it picks up more cosmetic, if the cosmetic is in powder form. It may also be not-smooth, cellular, or be coated in flock.

The applicator element may be rotary or otherwise, rigid, partially flexible, or entirely flexible. It is thus possible to replace a ball or a roller with an applicator pad constituted by a block of foam.

Finally, it will be observed that the coating roller may serve, because of its contact pressure against the applicator element, to compact the makeup thereon, and that can be advantageous when the makeup is in powder form, since it reduces the risk of the makeup being puffed away while it is being applied. The presence of the coating roller also contributes to having the makeup uniformly distributed over the applicator element, and that makes it possible to apply makeup flawlessly.

I claim:

1. A device for packaging and applying a cosmetic, the device comprising a housing suitable for containing said cosmetic, an applicator element for applying said cosmetic, and transfer means for feeding the applicator element with cosmetic taken from inside the housing, said transfer means including a coating roller rotatably mounted inside the housing, said roller having a region of its surface that is in contact with the applicator element and that is exerting contact pressure thereon, and a region of its surface that is in contact with the cosmetic contained in the housing, rotation of the roller conveying a coating of cosmetic between said regions for transfer to the applicator element because of said contact pressure, wherein the coating roller is secured to drive means accessible to the user outside the housing.

2. A device according to claim 1, wherein the applicator element is a rotary member.

3. A device according to claim 2, wherein the coating roller and the rotary member are organized to rotate in contact one with the other and have a transmission ratio selected so that said rotary member performs at least one complete turn when the coating roller performs half a turn.

4. A device according to claim 2, including means suitable for preventing rotation of the rotary member while the cosmetic is being applied to a user's skin.

5. A device according to claim 2, wherein the coating roller and the rotary member are organized to rotate in contact one with the other and have a transmission ratio selected so that said rotary member performs at least one complete turn when the coating roller performs one-fourth of a turn.

6. A device according to claim 1, including removable fixing means for fixing the applicator element on the housing.

7. A device according to claim 1, wherein the coating roller is resiliently urged against the applicator element.

8. A device according to claim 1, wherein the applicator element is resiliently urged against the coating roller.

9. A device according to claim 1, wherein said cosmetic is contained in a removable container.

10. A device according to claim 1, wherein the housing includes a transparent window enabling the cosmetic contained therein to be observed.

11. A device according to claim 1, wherein the applicator element has a shape and wherein the coating roller is of a shape that fits closely to the shape of the applicator element.

12. A device according to claim 1, wherein said coating roller is suitable for deforming under said contact pressure.

13. A device for packaging and applying a cosmetic, the device comprising a housing suitable for containing said cosmetic, an applicator element for applying said cosmetic, and transfer means for feeding the applicator element with cosmetic taken from inside the housing, said transfer means including a coating roller capable of rotating inside the housing, said roller having a region of its surface that is capable of coming into contact with the applicator element and of exerting contact pressure thereon, and a region of its surface that is capable of coming into contact with the cosmetic contained in the housing, rotation of the roller conveying a coating of cosmetic between said regions for transfer to the applicator element because of said contact pressure, wherein the coating roller is secured to drive means accessible to the user outside the housing, said device including removable fixing means for fixing the applicator element on the housing, wherein said removable fixing means include a pivoting clasp rotatable with the coating roller and suitable for being moved onto the applicator element to hold the latter on the housing.

14. A device for packaging and applying a cosmetic, the device comprising a housing suitable for containing said cosmetic, an applicator element for applying said cosmetic, and transfer means for feeding the applicator element with cosmetic taken from inside the housing, said transfer means including a coating roller capable of rotating inside the housing, said roller having a region of its surface that is capable of coming into contact with the applicator element and of exerting contact pressure thereon, and a region of its surface that is capable of coming into contact with the cosmetic contained in the housing, rotation of the roller conveying a coating of cosmetic between said regions for transfer to the applicator element because of said contact pressure, wherein the coating roller is secured to drive means accessible to the user outside the housing, wherein the applicator element is fixed in a non-rotatable manner to a handle member that is removable, and wherein the applicator element is made of a cellular material or of an elastomer cellular material.

15. A device for packaging and applying a cosmetic in powder form, the device comprising a housing having a cavity suitable for containing said cosmetic held loosely in said cavity, an applicator element for applying said cosmetic, and transfer means for feeding the applicator element with cosmetic taken from inside the housing, said transfer means including a coating roller rotatably mounted inside the housing, said roller having a region of its surface that is in contact with the applicator element and exerting contact pressure thereon, and a region of its surface that is in contact with the cosmetic contained in the housing, rotation of the roller conveying a coating of cosmetic between said regions for transfer to the applicator element because of said contact pressure, wherein the coating roller is secured to drive means accessible to the user outside the housing, the housing being shaped so that the coating roller isolates the applicator element from the cavity containing the cosmetic.

* * * * *